US006431940B1

(12) United States Patent
Buford et al.

(10) Patent No.: US 6,431,940 B1
(45) Date of Patent: Aug. 13, 2002

(54) ANIMATED TOY DOLL AND SCOOTER ASSEMBLY

(75) Inventors: Jonathan L. Buford, Canoga Park; Ben Ton, Northridge, both of CA (US)

(73) Assignee: ABC International Traders, Inc., North Hills, CA (US)

( * ) Notice: Subject to any disclaimer, the term of this patent is extended or adjusted under 35 U.S.C. 154(b) by 0 days.

(21) Appl. No.: 09/780,794

(22) Filed: Feb. 9, 2001

(51) Int. Cl.[7] ..... A63H 11/02
(52) U.S. Cl. ..... 446/277; 446/286; 446/454
(58) Field of Search ..... 446/269, 268, 446/275, 276, 277, 279, 280, 294, 286, 288, 454, 431, 456

(56) References Cited

U.S. PATENT DOCUMENTS 1,351,147 A * 8/1920 Zsarnay
1,461,313 A 7/1923 Hebrard
1,610,568 A * 12/1926 Marx
1,890,755 A 12/1932 Shepherd
2,251,006 A * 7/1941 Savage
2,566,141 A 8/1951 Poli
2,645,056 A * 7/1953 Manigold
3,574,969 A 4/1971 Cleveland et al.
3,664,670 A * 5/1972 Glass et al.
4,846,752 A 7/1989 Combs
5,094,646 A * 3/1992 Marceau
6,315,630 B1 * 11/2001 Yamasaki

* cited by examiner

*Primary Examiner*—Jacob K. Ackun
(74) *Attorney, Agent, or Firm*—Oppenheimer Wolff & Donnelly, LLP

(57) ABSTRACT

A toy doll is articulated and removably attached to a toy scooter so that the doll's arms appear to steer the scooter and the doll's foot appears to tilt downward to push back against the ground and propel the scooter. Additionally, the animated toy doll and scooter assembly is controlled by a radio remote control unit itself shaped like a scooter and having a toy foot attached to it. The toy foot is slid forward or back to control the forward and reverse motion of the scooter and is turned to steer the scooter.

18 Claims, 5 Drawing Sheets

ANIMATED TOY DOLL AND SCOOTER ASSEMBLY

BACKGROUND OF THE INVENTION

The invention relates generally to toys, and more particularly to an animated toy doll and scooter assembly.

U.S. Pat. No. 3,574,969 to Cleveland and Wilson discloses a toy doll and scooter assembly wherein a doll is attached to a scooter and uses a walking motion to push the scooter along. However, Clevland lacks realistic animation of the doll. The scooter tilts from side to side, as in a walking motion, rather than remaining substantially vertical as do real scooters. Additionally, Cleveland is only able to travel forward and cannot be turned like a real scooter.

SUMMARY OF THE INVENTION

A general object of the present invention is to provide a more realistically animated toy doll and scooter assembly.

In accordance with an illustrative embodiment of the invention, a toy doll is articulated and removably attached to a toy scooter so that the doll's arms appear to steer the scooter and the doll's foot appears to propel the scooter. Additionally, the animated toy doll and scooter assembly is controlled by a radio remote control unit itself shaped like a scooter and having a toy foot attached to it. The remote control unit provides a highly intuitive method for controlling the animated toy doll and scooter assembly. By sliding the attached foot forwards or backwards, the animated toy doll and scooter assembly is commanded to travel forwards or backwards. By turning the attached left or right the animated toy doll and scooter assembly is commanded to turn left or right.

More specifically, an animated toy doll and scooter assembly is provided which includes a toy scooter having front and rear large size main wheels and several smaller stabilizing wheels. The scooter has a pivotal front wheel for turning, and handlebars linked to the front wheel. A doll is mounted on the scooter with its arms secured to the handlebars. The scooter has a motor mounted thereon for actuating at least one of the wheels for forward movement. The doll has a leg and foot assembly linked to the motor for movement up and down, or tilting, and front to rear to simulate scooter actuation motion. In addition, a second motor may be provided, or a coupler from the first motor may be provided, to turn the front wheel of the scooter.

These objects as well as other objects, features and advantages of the invention will become more apparent to those skilled in the art from the following description with reference to the accompanying drawings.

BRIEF DESCRIPTION OF THE DRAWINGS

Detailed description of the preferred embodiment of the invention will be made with reference to the accompanying drawings.

DETAILED DESCRIPTION OF THE PREFERRED EMBODIMENTS

Disclosed herein is a detailed description of the best presently known modes of carrying out the invention. This description is not to be taken in a limiting sense, but is made merely for the purpose of illustrating the general principles of the invention. The overall organization of the present detailed description is for the purpose of convenience only and is not intended to limit the present invention.

Figure 1:
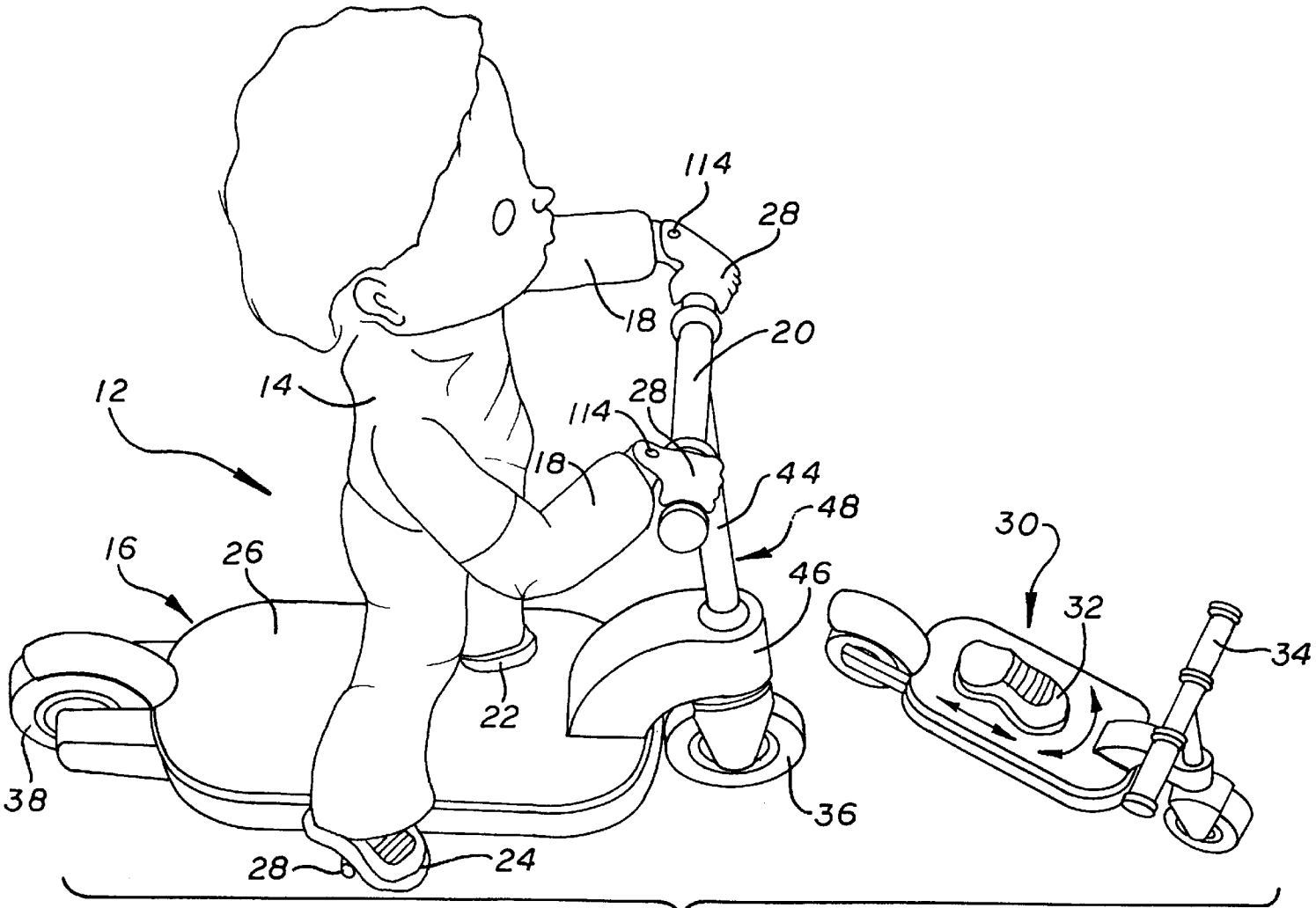
FIG. 1 is a top-perspective view of the animated toy doll and scooter assembly and remote control unit illustrating the principles of the present invention.

FIG. 1 shows an animated toy doll and scooter assembly 12 including a toy doll 14 positioned on a toy scooter 16. Arms 18 are secured to scooter handlebars 20. A foot 22 supports the doll on a floorboard 26 of the scooter. Another foot 24 is positioned on a foot movement actuating member 28. Also shown are front 36 and rear 38 large size main wheels. The rear wheel 38 can be used to propel the scooter 16 while the front wheel 36 is used to steer the scooter 16. A steering assembly 48 is made up of the handlebars 20, a steering column housing 44, a steering actuating assembly 46 and the front wheel 36.

In one embodiment the animated toy doll and scooter assembly is controlled by a radio remote control unit 30. The radio remote control unit 30 contains a radio transmitter as known in the art. The remote control unit 30 is shaped as a smaller version of the toy scooter 16. The remote control unit can transmit radio signals through an antenna extending along the remote control unit 30 handlebars 34. The remote control unit 30 can be two-thirds or less of the size of the toy scooter 16 so that it can be easily held by a child. Mounted on a sliding switch is a toy shoe 32. By sliding the toy shoe forward and backward along a remote control floorboard 33, a user can make the toy scooter 16 move forwards and backwards. Positioning the toy shoe to an intermediate position stops the scooter and moving the toy shoe further to the front or rear increases the forward or reverse speed of the toy scooter. By turning the foot 32 clockwise or counterclockwise, a user can similarly make the scooter handlebars 20 turn clockwise or counterclockwise, and turn a front wheel 36, causing the forward moving scooter to turn right or left. Radio remote control units are known in the art, however, the remote control unit 30 of the present invention provides special advantages when included with the animated toy doll and scooter assembly of the present invention. The design of the remote control unit 30 makes its use in controlling the toy scooter 16 highly intuitive, allowing younger children to quickly comprehend how to use the remote control unit 30 to control the toy scooter 16.

Figure 2:
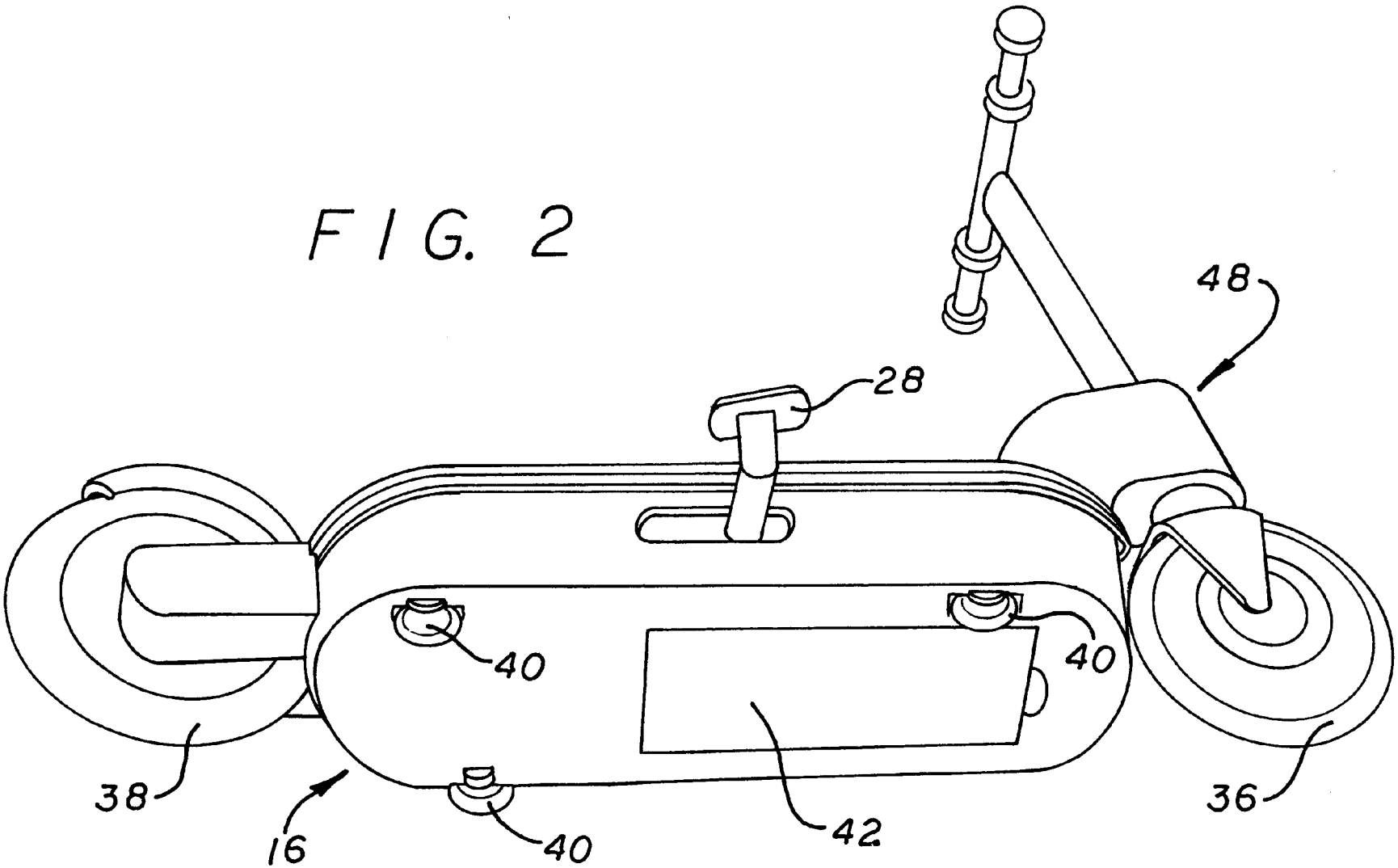
FIG. 2 is a bottom-perspective view of the scooter of FIG. 1.

FIG. 2 shows the toy scooter 16 from a bottom perspective. Three small stabilizing wheels 40 are shown. The stabilizing wheels 40 can have diameters less than two-thirds the diameter of the main wheels 36, 38. The stabilizing wheels are mounted on opposite sides of the scooter. As illustrated in FIG. 1, the doll tends to move the center of gravity of the animated toy doll and scooter assembly 12 away from the center of the floorboard 26 and towards the foot movement actuating member 28. It is therefore particularly important to have at least one stabilizing wheel positioned on the same side of the scooter as the foot movement actuating member 28. Also shown is a battery compartment cover 42 for allowing insertion and removal of batteries. In one embodiment 6 AA batteries, providing approximately 9 V, can be used to power the animated toy doll and scooter assembly.

Figure 3:
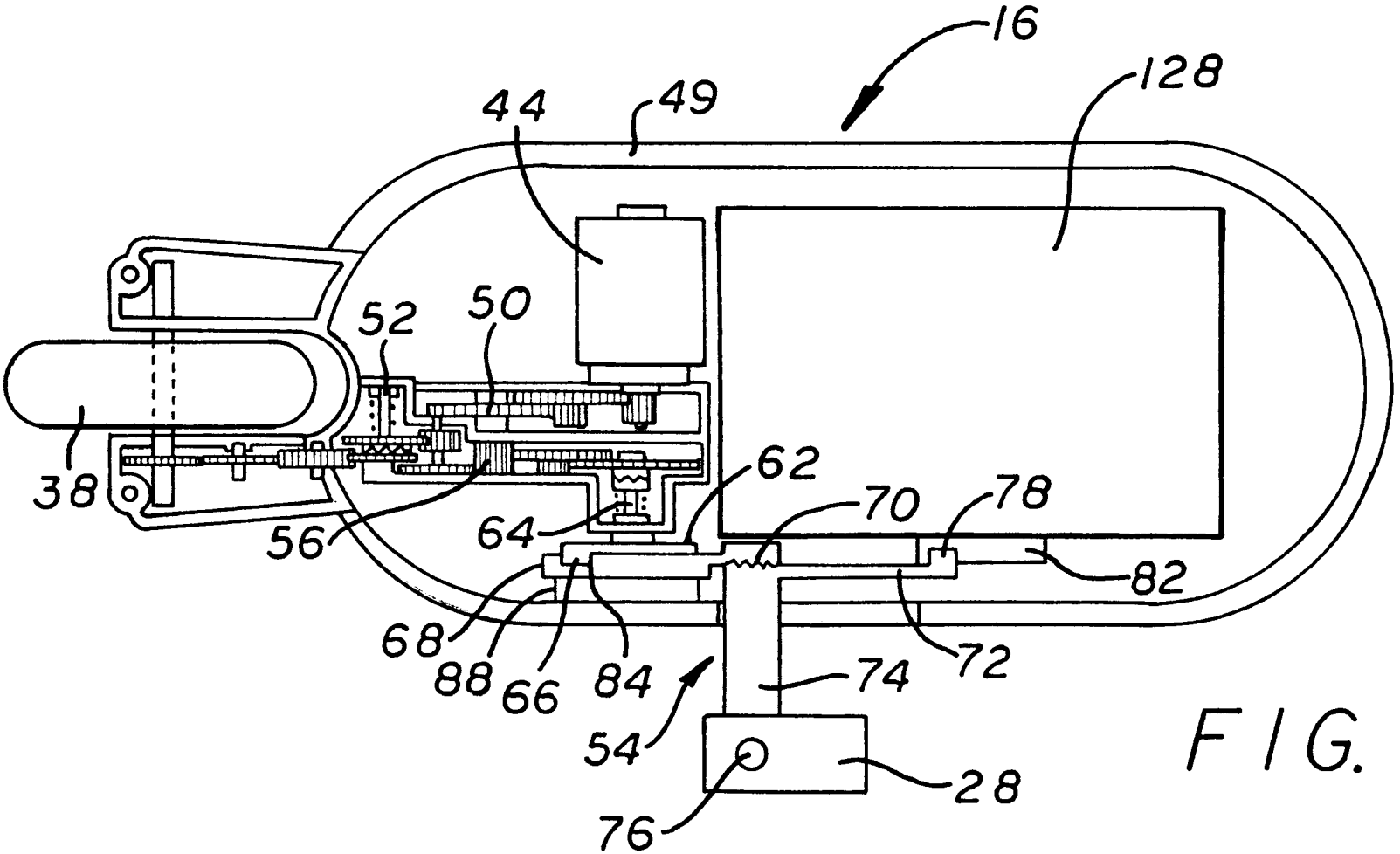
FIG. 3 is a top view of the scooter of FIG. 1 with the top section removed to show the inside.

FIG. 3 shows a top view of the scooter with the top section and the steering assembly 48 removed from casing walls 49 to show the inner operating mechanisms. The scooter 16 is propelled by a drive motor 44 powered by the batteries or other power source. The motor 44 turns the rear wheel through a step-down gear train 50. The gear train 50 transfers the relatively fast spinning of the motor to a relatively slow, but more powerful, spinning of the wheel 38. Included in the gear train 50 is a clutch 52 for preventing the burning out of the motor 44 when the wheel 38 experiences an excess amount of resistance to spinning. The speed of the motor is controlled by sliding the toy foot 32 of the remote control 30 forward and backward. As the toy foot 32 is slid further forward, the motor 44 spins faster in the forward driving direction. As the toy foot 32 is slid further backward, the motor 44 spins faster in the reverse driving direction. The motor 44 stops spinning when the toy foot 32 is positioned and an intermediate position approximately between the furthest forward and furthest back sliding positions.

Driven by the same motor 44 is a foot-pedal actuation mechanism 54. The foot-pedal actuation mechanism 54 gives the foot 24 and leg segments 58, 60 of the doll 14 (see FIG. 4) a pedaling motion whereby the foot is tilted and moved from front to rear, simulating a driving engagement of the foot with the ground. The motor 44 actuates the pedaling mechanism 54 through a step-down gear train 56. The gear trains 50, 56 share some of the same gears. Thus, the foot 24 pedaling motion corresponds to the speed of the scooter 16. As the scooter 16 goes faster, the foot 24 pedals faster, and as the scooter 16 goes slower, the foot 24 pedals slower. Alternatively, separate motors can be used to propel the scooter 16 and move the foot movement actuating member 28.

The foot-pedal actuation mechanism 54 is described with reference to FIGS. 3, 5 and 7–10. The foot-pedal actuation mechanism 54 includes a pedal drive cam 62 rotated by a shaft 64 which is rotated by the gear train 56. A peg 66 extends outwardly from the cam 62 to engage a linear cam follower 68. The follower 68 has a vertical slot 84 along which the peg 68 rides up and down. On the face of the follower 68 opposite the slot 84 is a horizontal slot 86 into which a shelf 88 extends from the casing wall 49. The horizontal slot 86 and shelf 88 limit the follower to substantially horizontal motion. Pivotally connected to the follower 68 at a pivot point 70 is a foot-tilting follower 72. Rigidly connected to the follower 72 is foot tilting shaft 74 having a foot movement actuating member 28 and a foot securing pin 76 attached at the opposite end. The pin 76 is used to help removably secure the foot 24 to the foot movement actuating member 28. Extending from the follower 72 is a peg 78 which rides inside a groove 80 within a camming groove piece 82.

The operation of the foot-pedal actuation mechanism 54 is now described with particular reference to FIGS. 7–10. The pedal drive cam 62 rotates about a fixed axis causing the peg 66 to ride up and down in the vertical slot 84 formed in the linear cam follower 68. The follower 68 is constrained to substantially horizontal motion by the shelf 88 around which the horizontal slot 86 slides. Thus the rotation of the cam 62 leads to substantially linear horizontal motion of the follower 68. As the follower 68 moves horizontally, the foot-tilting follower 72 moves forward and back and pivots relative to the follower 68 about the pivot point 70. The peg 78 is driven around the groove 80 of the stationary camming groove piece 82. The foot 24, attached to the foot tilting shaft 74, is thus tilted up and down and moved from front to rear, simulating a driving engagement of the foot with the ground. During forward motion the cam spins in the clockwise direction illustrated by arrows 90, driving the peg 78 around the groove 80 in the clockwise direction illustrated by arrows 92. During reverse motion the directions are also reversed.

Figure 7:
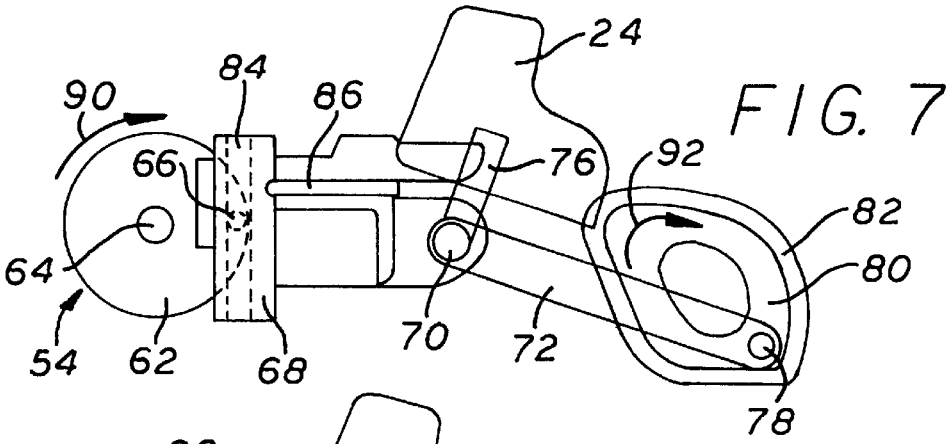
FIGS. 7–10 are semi-diagrammatic side elevational views showing the operating principal of the foot-pedaling mechanism.

FIG. 7 illustrates the foot-pedal actuation mechanism 54 with the foot 24 driven to its forward-most position by the cam 62. At the same time, the foot is tilted downwards to a toe-down position by the peg 78 reaching the bottom-forward position in of groove 80. This position simulates the foot 24 at the forward position with the toes down and ready to push back against the ground to drive the toy scooter 16.

Figure 8:
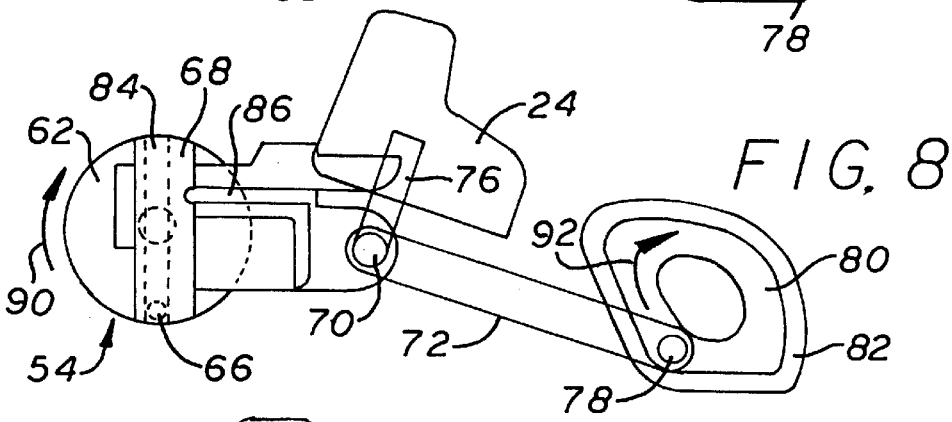

FIG. 8 illustrates the foot-pedal actuation mechanism 54 with the foot 24 driven to an intermediate position by the cam 62 with the peg 78 reaching the bottom-rear position of the groove 80. This position simulates the foot 24 final position at which the toes have finished pushing back against the ground yet are still pointing down.

Figure 9:
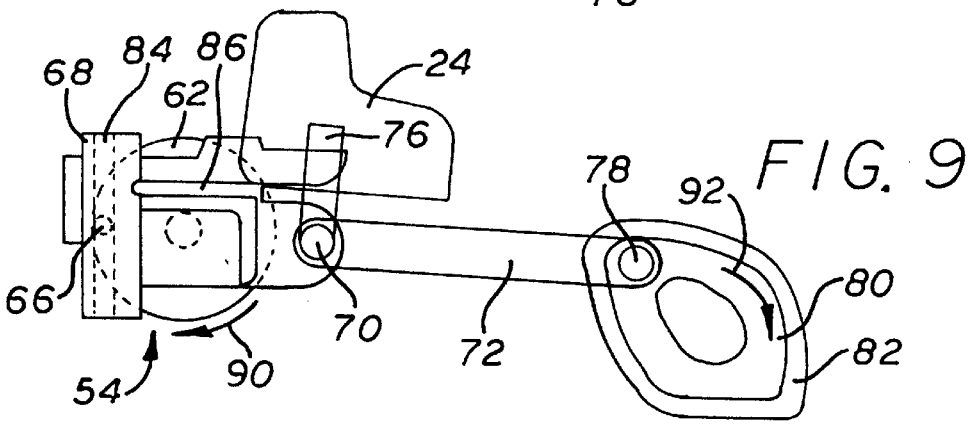

FIG. 9 illustrates the foot-pedal actuation mechanism 54 with the foot 24 driven to its rear-most position by the cam 62. At the same time, the foot is returned to a raised, toe-up horizontal position by the peg 78 reaching the top-rear position in of groove 80. This position simulates the foot 24 lifted up from engagement with the ground and ready to move forward.

Figure 10:
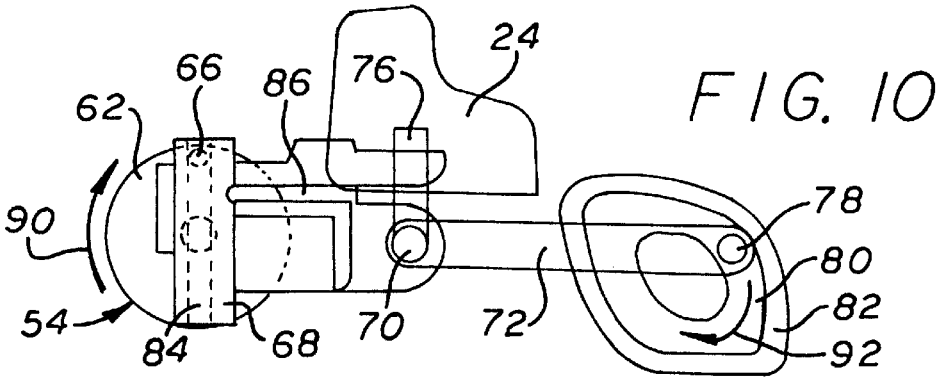

FIG. 10 illustrates the foot-pedal actuation mechanism 54 with the foot 24 driven to an intermediate position by the cam 62 and with the peg 78 reaching the top-front position of the groove 80. This position simulates the foot 24 returned to a forward position just before lowering the toes again in preparation for pushing back against the ground.

Figures 4, 5, 6:
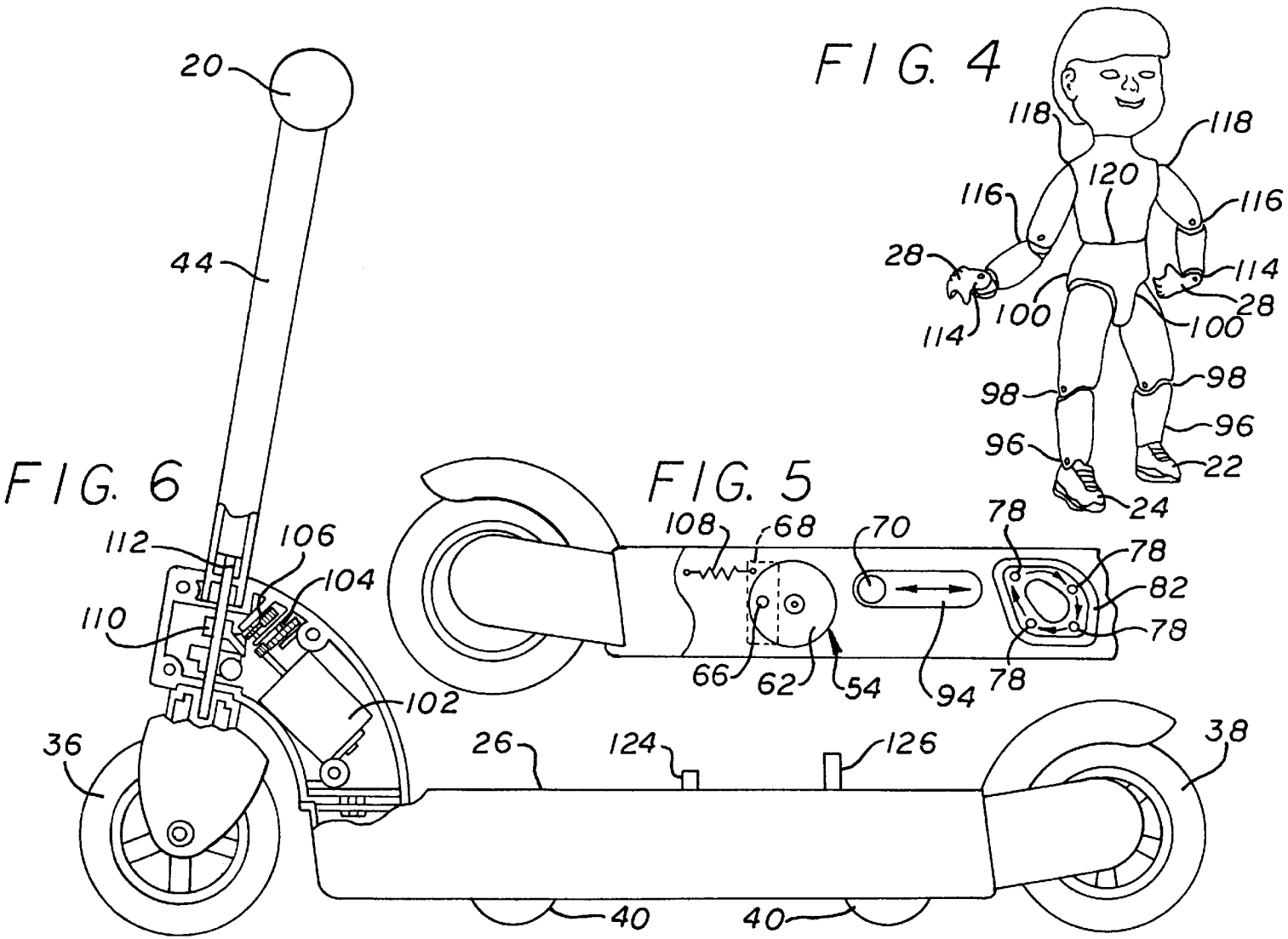
FIG. 4 is a perspective view of the toy doll of FIG. 1 showing the bending joints.
FIG. 5 is a semi-diagrammatic fragmentary partial side elevational view of the scooter showing the foot-pedaling mechanism.
FIG. 6 is a semi-diagrammatic partial side elevational view of the scooter showing the steering mechanism.

FIG. 5 diagrammatically shows a side view of the foot-pedal actuation mechanism 54 relative to the scooter 16. The forward and back motion of the foot tilting shaft is illustrated within a slot 94. Also illustrated is the motion of the peg 78 around the camming groove piece 82. An optional spring 108 is shown attaching the follower 68 to a rearward fixed position. The spring is stretched as the foot 24 moves forward so that the foot will move faster during the backward motion than the forward motion giving the doll 14 an appearance of strongly pushing back against ground.

When the scooter 16 travels in the backward direction all directions illustrated FIGS. 3, 5 and 7–10 and described in the corresponding descriptions are reversed.

As illustrated in FIG. 4, the doll 14 is articulated with ankle joints 96, knee joints 98 and hip joints 100 so that the foot 24 can be tilted down and lifted up and so that the entire leg can move forward and backward with the foot movement actuating member 28.

The operation of the steering mechanism is now described with particular reference to FIG. 6. A steering motor 102 turns a drive train 104 comprising step down gears. The drive train 104 transfers spinning motion to a pinion 106 which then causes a rack 110 to turn a steering column 112. The steering column 112 then causes the front wheel 36 and handlebars 20 to turn together. The step down gears 104 transfer the relatively fast spinning motion of the motor 102 to a relatively slow motion of the pinion 106. The steering column 112 can be biased with a centering spring. In one embodiment, the front wheel 36 can be steered through a 74 degree range.

As shown in FIG. 4, the doll 14 is articulated with wrist joints 114, elbow joints 116, shoulder joints 118 and a waist joint 120. When the doll 14 is placed on the scooter 16, the foot 24 is removably secured to the floorboard 26 using two pegs 124, 126 disposed to fit within two holes formed in the bottom of the foot 22. Also, the peg 76 is fit within a hole formed in the bottom of the foot 24. Hands 28 are then removably secured to the handlebars 20 as illustrate in FIG. 1. The shoulder joints 118 are used to raise the hands to the proper level. The wrist joints 114 are especially designed to generally pivot within a plane approximately formed between the elbows and the handlebars. The elbow joints 16 also pivot within the same plane as the wrist joints 114. Thus, as the handlebars 20 turn the jointed arms 18 appear to be steering the scooter 16 in a life-like manner.

Returning to FIG. 3, within an electronics area 128 are conventional radio receiving circuits for receiving commands from the remote control 30. Also within the electronics area 128 are circuits for controlling the motors 44, 102. The 6 AA batteries are located at the bottom of the electronics area 128.

In one embodiment, the scooter is less than two feet long, and in particular approximately one foot long measured from the furthest forward part of the wheel 36 to the furthest rearward part of the wheel 38. The floorboard 26 can have a length of approximately 7.5 inches and a width of approximately 3.5 inches. The scooter can have a height of approximately 9 inches from the bottom of the wheels 36, 38 to the top of the handlebars 20. The height from the bottom of the wheels 36, 38 to the top of the floorboard can be approximately 1.5 inches. The wheels 36, 38 can have diameters of approximately 2.25 inches. The stabilizing wheels 40 can have diameters of approximately 0.5 inches.

As for the remote control unit 30, the total length can be approximately 7.5 inches, and the height from the bottom of the wheels to the handlebars can be approximately 5 inches. The width can be approximately 2.75 inches.

The present invention is not limited to scooters. The invention can take the form of other types of vehicles as well, such as skateboards or motorcycles, by way of examples, but not of limitation. For example, it can take the form of vehicles having one, three, four or other numbers of wheels. Also, instead of using wheels, slides can be used as the main or stabilizing structures. Furthermore, different types of dolls can be used to ride the vehicle. Also, the invention is not limited to use with a particular type of controller. Any kind of controller can be used or else the animated toy doll and scooter assembly can have a memory and processor onboard, for example, to lead the animated toy doll and scooter assembly on a particular predetermined or random course. Accordingly, the invention is not limited to the precise embodiments described in detail hereinbefore.

What is claimed is:

1. An animated toy doll and scooter assembly comprising:

a toy scooter not more than two feet long;

said scooter having front and rear large size main wheels;

said scooter also having at least two small stabilizing wheels less than two-thirds the diameter of said main wheels, said stabilizing wheels being mounted on opposite sides of said scooter;

said scooter having a pivotal front wheel for turning the scooter, and handlebars linked to said front wheel;

a doll mounted on said scooter, said doll having arms secured to said handlebars;

said scooter having batteries and a motor mounted thereon for actuating at least one of said wheels for forward movement;

said doll having a leg and foot assembly linked to said motor for movement up and down and front to rear to simulate scooter actuation motion.

2. An assembly as defined in claim 1 wherein said scooter has a second motor mounted thereon and coupled to pivot said front wheel, and concurrently rotate said handlebars with the doll arms secured thereto.

3. An assembly as defined in claim 1 wherein camming arrangements are provided to tilt the foot of said doll to simulate driving engagement of the foot.

4. An assembly as defined in claim 1, further comprising a remote control unit for controlling the assembly, said remote control unit including a transmitter for transmitting commands to the scooter; and a receiver within the scooter for receiving the commands.

5. An assembly as defined in claim 4, wherein said remote control unit comprises:

a housing shaped as a scaled-down scooter so as to be easily held and manipulated by a small child;

a transmitter within the housing for contacting a receiver on said scooter; and a toy shoe positioned on a floorboard of the remote control unit for sliding forward and backward to control said scooter to move forward and backward and for turning to control the left and right steering of said scooter.

6. An animated toy doll and vehicle assembly comprising:

a toy vehicle;

said vehicle having front and rear large size main wheels;

said vehicle also having at least one stabilizing wheel in addition to said main wheels;

a doll mounted on said vehicle;

said vehicle having a motor mounted thereon for actuating at least one of said wheels for forward movement;

said doll having a leg and foot assembly linked to said motor for tilting and front to rear motion to simulate a propelling motion;

a remote control unit for controlling the assembly, said remote control unit including a transmitter for transmitting commands to the vehicle;

a receiver within the vehicle for receiving the commands;

said remote control unit comprises:

a housing shaped as a scaled-down toy vehicle so as to be easily held and manipulated by a small child;

a twitter within the housing for contacting a receiver on said toy vehicle; and a toy shoe positioned on a floorboard of the remote control unit for sliding forward and backward to control said vehicle to move forward and backward and for turning to control the left and right steering of said vehicle.

7. An assembly as defined in claim 6 wherein said vehicle has handlebars with arms of the doll removably secured thereto and has a second motor mounted thereon and coupled to pivot said front wheel, and concurrently rotate said handlebars with the doll arms secured thereto.

8. An assembly as defined in claim 7 wherein said motor actuates the rear wheel.

9. An assembly as defined in claim 7, wherein:

the doll has wrist joints and elbow joints generally pivoting within a plane approximately formed between the elbow joints and the handlebars so that the arms appear to steer the scooter.

10. An assembly as defined in claim 6 wherein camming arrangements are provided to tilt and move forward and backward the foot of said doll to simulate a pedaling motion.

11. An assembly as defined in claim 10, wherein:

said leg and foot assembly is linked to said motor using a first step-down gear train and at least one of said wheels is actuated by said motor using a second step-down gear train, said gear trains sharing some gears so that the speed of the foot pedaling motion corresponds to the speed of the vehicle.

12. An assembly as defined in claim 10, wherein the vehicle is a scooter.

13. An assembly as defined in claim 10, wherein said camming arrangements include a pedal drive cam for imparting linear motion to a linear cam follower and for imparting linear motion to the foot.

14. An assembly as defined in claim 13 wherein the linear cam follower is constrained to substantially horizontal motion by a shelf extending from an inner wall of the assembly and around which a horizontal slot formed in the linear cam follower slides.

15. An assembly as defined in claim 14, further comprising:

a spring attaching the linear cam follower to a rearward fixed position so that the foot will move faster when the foot is moving backward than when the foot is moving forward.

16. An assembly as defined in claim 14, further comprising:

a foot-tilting follower pivotally connected to the linear cam follower at a first end of the foot-tilting follower;

a camming groove piece with a groove within which a second end of the foot-tilting follower rides, said camming grove piece imparting tilting motion to the foot.

17. An assembly as defined in claim 16, further comprising:

a foot-tilting shaft extending from the pivot connection of the foot-tilting follower and linear cam follower and rigidly connected to the foot-tilting follower, the foot-tilting shaft linking the foot to the camming arrangements.

18. An assembly as defined in claim 17, wherein:

for forward travel of the vehicle, as the second end of the foot tilting follower rides within said groove, the foot maintains a substantially horizontal position when moving forward and tilts to a toe-down position when moving backward.

* * * * *